United States Patent [19]

Van den Bogaert

[11] 3,935,455

[45] Jan. 27, 1976

[54] METHOD AND APPARATUS FOR PRODUCING ELECTROSTATIC CHARGE PATTERNS

[75] Inventor: Jan Van den Bogaert, Schilde, Belgium

[73] Assignee: AGFA-GEVAERT N.V., Mortsel, Belgium

[22] Filed: Nov. 30, 1973

[21] Appl. No.: 420,558

[30] Foreign Application Priority Data

June 4, 1973 United Kingdom ..... 26582/73

[52] U.S. Cl. ..... 250/315; 250/324

[51] Int. Cl. ..... G03g 13/00; G03g 15/00

[58] Field of Search ..... 250/213 VT, 315, 315 A, 250/324, 325, 326; 346/74 CR, 74 ES, 74 EB; 355/3 R, 17

[56] References Cited

UNITED STATES PATENTS

| | | | |
|---|---|---|---|
| 3,041,611 | 6/1962 | Moss | 346/74 |
| 3,508,477 | 4/1970 | Groo | 250/315 |
| 3,757,351 | 9/1973 | Simms | 346/74 |
| 3,774,029 | 11/1973 | Muntz et al. | 250/315 |

FOREIGN PATENTS OR APPLICATIONS

| | | | |
|---|---|---|---|
| 1,497,093 | 8/1970 | Germany | 250/315 |

*Primary Examiner*—James W. Lawrence
*Assistant Examiner*—C. E. Church
*Attorney, Agent, or Firm*—William J. Daniel

[57] ABSTRACT

A method of recording an electrostatic charge pattern representing information to be recorded and generated in the interior of an air-tight envelope or chamber comprising a target towards which charged particles are projected, characterized in that the electrostatic charge pattern is produced within the envelope on an electrically insulating surface of a charge receiving material and (1) according to a first mode the charge pattern from such surface is transferred through an array of closely spaced solid conductors, held a solid electrically insulating matrix, to an uncharged electrically insulating surface of an other charge receiving material removably positioned at the outer side of the envelope or (2) according to a second mode the charge pattern from such surface is transferred through said conductors to an oppositely charged electrically insulating surface of a charge receiving material removably positioned at the outer side of the envelope forming according to the second mode a charge pattern in accordance with the unneutralized area of the exterior insulating surface.

21 Claims, 4 Drawing Figures

METHOD AND APPARATUS FOR PRODUCING ELECTROSTATIC CHARGE PATTERNS

Figure 1:
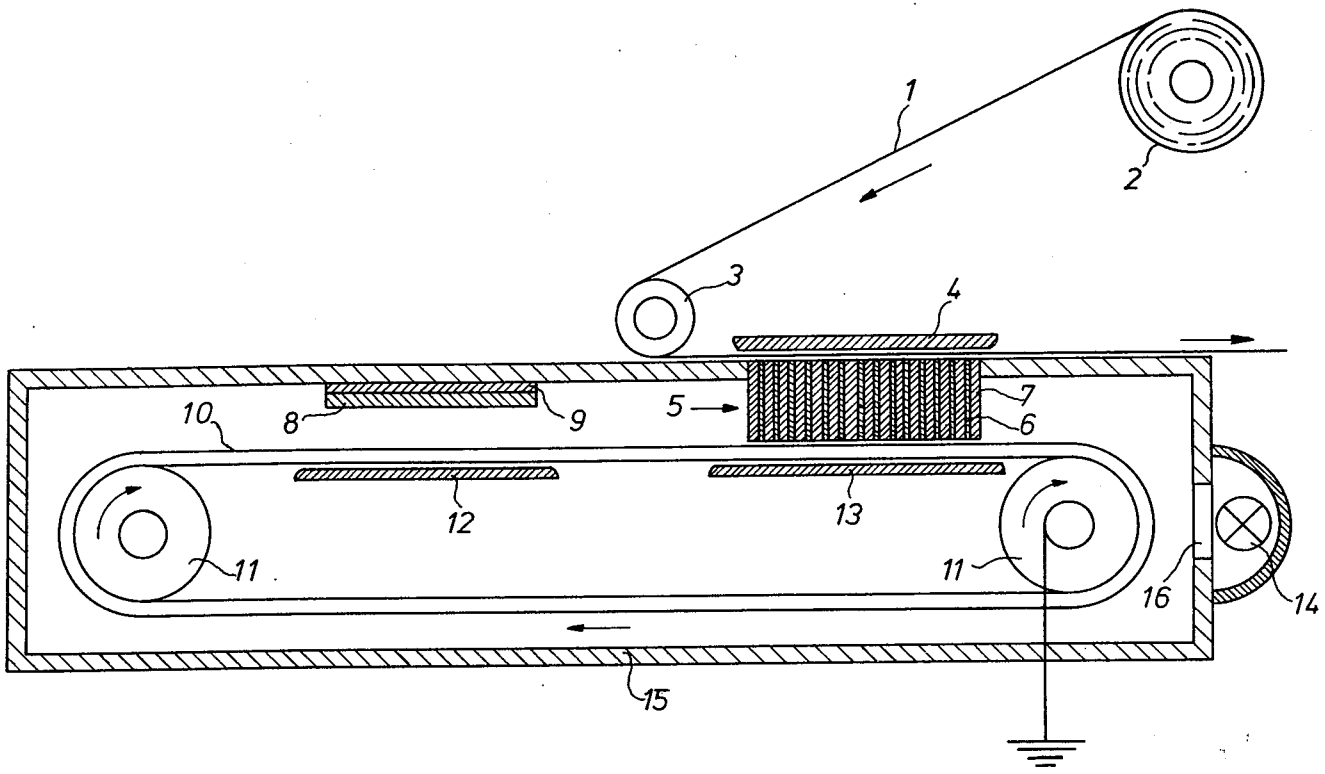

This invention relates to a process for forming developable electrostatic charge patterns and devices for producing such patterns.

From German patent specification No. 1,497,093 an imaging technique is known in which a photocathode is used to produce an electrostatic charge pattern on a non-photosensitive insulating material. In this technique an air-tight chamber is filled with an ionizable gas e.g. a mixture of argon and monobromotrifluoromethane (1:5) and is provided with a photocathode and an anode, the latter being covered by an insulating recording material, e.g. insulating resin sheet. Simultaneously with X-ray exposure, which is modulated by the subject being X-rayed a direct current potential is applied accross the electrodes so that photoelectrons, which are ejected image-wise from the photocathode, are strongly intensified by an avalanching action occuring in the ionizable gas. The electrons are collected on the insulating material in an image pattern corresponding to the intensity of the imaging radiation absorbed by the photocathode.

The above described technique is particularly attractive for the recording of X-ray images. According to this system, the X-rays liberate electrons from a photocathode, which electrons are accelerated by the electric field applied. Due to the accelerating effect the electrons collide strongly with the gas molecule of the ionizable gas and produce more electrons and ions that are received as a charge pattern on the insulating material. By this avalanching effect a considerable increase in speed in obtained so that the necessary X-ray dose can be considerably reduced.

In the execution of this concept the distance between the electrodes ranges from 0.3 to 3 mm and the interspace between the electron emitting electrode and the charge receiving insulating material is preferably filled with an ionizable bas kept under an over-pressure of a few Torr e.g. 3 to 5 Torr. To prevent self-sustaining electric discharge, a quenching additive is added to the ionizable gas or gas mixture which may be e.g. ethanol vapour or a haolgen.

A particularly useful gas mixture consists of argon and monobromotrifluoromethane ($CF_3Br$) in the ratio 1:5.

When using in the gas mixture a fluoromethane such as carbon tetrafluoride, monochlorotrifluoromethane or monobromotrifluoromethane, a separate discharge quenching additive is not required, since the electron avalanching stops almost simultaneously with the termination of the emission of the image-wise generated electrons.

A DC voltage is applied on both electrodes so that between them preferably a voltage is maintained of a magnitude from 1 to 5 % above the breakdown voltage of the gas or gas mixture in a homogeneous electric field.

In the recording apparatus described in the above German Patent Specification a polyester foil is used as the charge receiving insulating sheet. At the sides the polyester sheet is pressed on sealing strips in order to keep the interspace filled with the ionizable gas. Each electrostatic image is obtained on a separate insulating sheet and is tonerdeveloped on said sheet. Such procedure requires for each recording operation that air be admitted into the interspace filled with ionizable gas consequently, it is necessary to remove a sufficient amount of that air and replace it with by the desired ionizable gas before the production of the next print can start.

From Belgian Pat. No. 792,334 is known a process for the production of an electrostatic image which is characterized by the steps of (1) placing a dielectric sheet between an anode and a cathode, (2) allowing to be absorbed in the interspace between the anode and cathode in which interspace a gas with an atomic number of at least equal to 36, preferably xenon, is kept at a pressure above atmospheric pressure, forming by the X-ray absorption electrons and positive ions, (3) attracting the electrons towards the anode and the positive ions to the cathode by applying a potential difference between the electrodes to deposit one of the types of the charged particles onto the dielectric sheet.

In the process as examplified by the FIG. 1, 5 and 6 of such Belgian Patent a cassette is used which has to be opened and filled with the ionizable gas before the production of a new print can start.

This makes the production of several subsequent prints rather time consuming, and makes it difficult to avoid the loss of the rather expensive ionizable gas.

It is one of the objects of the present invention to provide a process for producing an electrostatic charge pattern in an ionizable gas medium or high vacuum medium in which the charge pattern is transferred outside the ionizable gas or vacuum medium without substantially changing the pressure and gas composition of the medium in which the charge pattern is formed.

It is a special object of the present invention to produce that charge pattern with photo-electrons emitted inan ionizable gas under reduced pressure in order to obtain electron multiplication by the electron avalanching effect.

It is a further special object of the present invention to produce that charge pattern under high vacuum conditions with photo-electrons multiplied by secondary emission in a special matrix from which the electrons in substantial configuration with the photo-exposed area of a photocathode are projected onto an insulating target.

It is another special object of the present invention to produce that charge pattern in an ionizable gas medium at a pressure equal to or above atmospheric pressure and to use therefor an ionizable gas having a hgh inherent X-ray absorption.

A still further object of the present invention is to provide devices for achieving the above objects.

Still further objects, features and advantages of the present invention will become apparent upon consideration of the following disclosure.

According to the present invention a method of recording an electrostatic charge pattern representing information to be recorded and generated in the interior of an air-tight envelope or chamber comprising a target towards which the charged particles e.g. electrons are projected, is characterised in that the electrostatic charge pattern is produced within the envelope on an electrically insulating surface of a charge receiving material and (1) according to a first mode the charge pattern from the surface is transferred through an array of closely spaced solid conductors held in a solid electrically insulating matrix, to an uncharged electrically insulating surface of an other charge receiving material removably positioned at the outer side of the envelope or (2) according to a second mode said charge pattern from such surface is transferred through the array of conductors to an oppositely charged electrically insulating surface of a charge receiving material removably positioned at the outer side of the envelope, whereby a charge pattern corresponding with the unneutralized area of the exterior insulating surface.

According to a preferred embodiment charge transfer through the conductors is improved applying a potential difference of the same field direction as the internally produced charge pattern. The field is applied across the insulating material inside the envelope (called hereinafter "internal insulating material") and the insulating material outside the envelope called hereinafter "external insulating material".

Although in the present disclosure reference is made to "charges" resulting from electrons (both photoelectrons and secondary emission electrons) this term is not intended to be limited thereto, since the "charges" may be built up by electrons and/or ions formed in the envelope.

Figure 2:
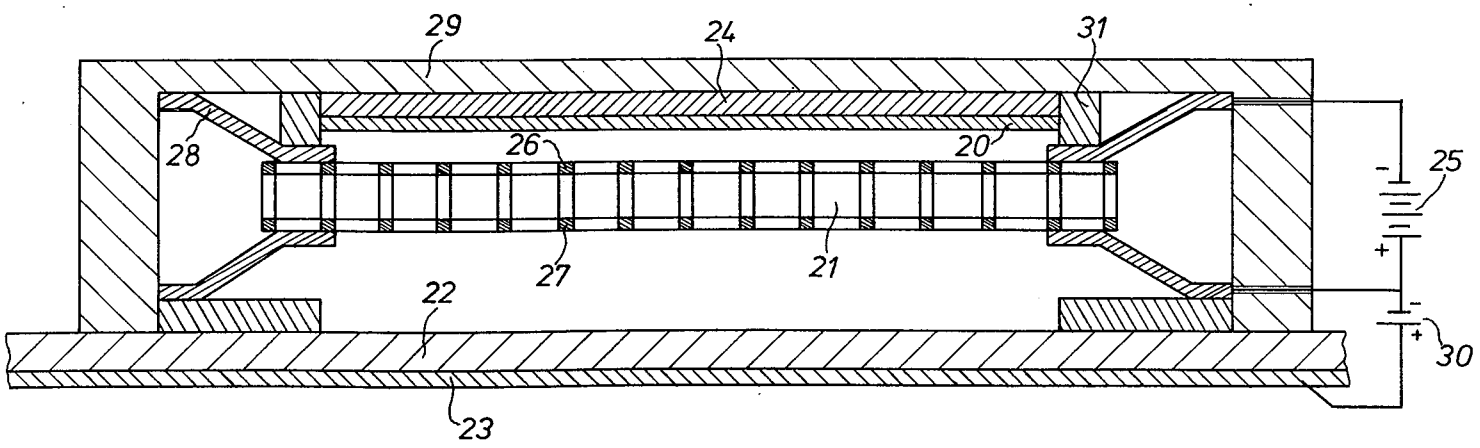
Figure 3:
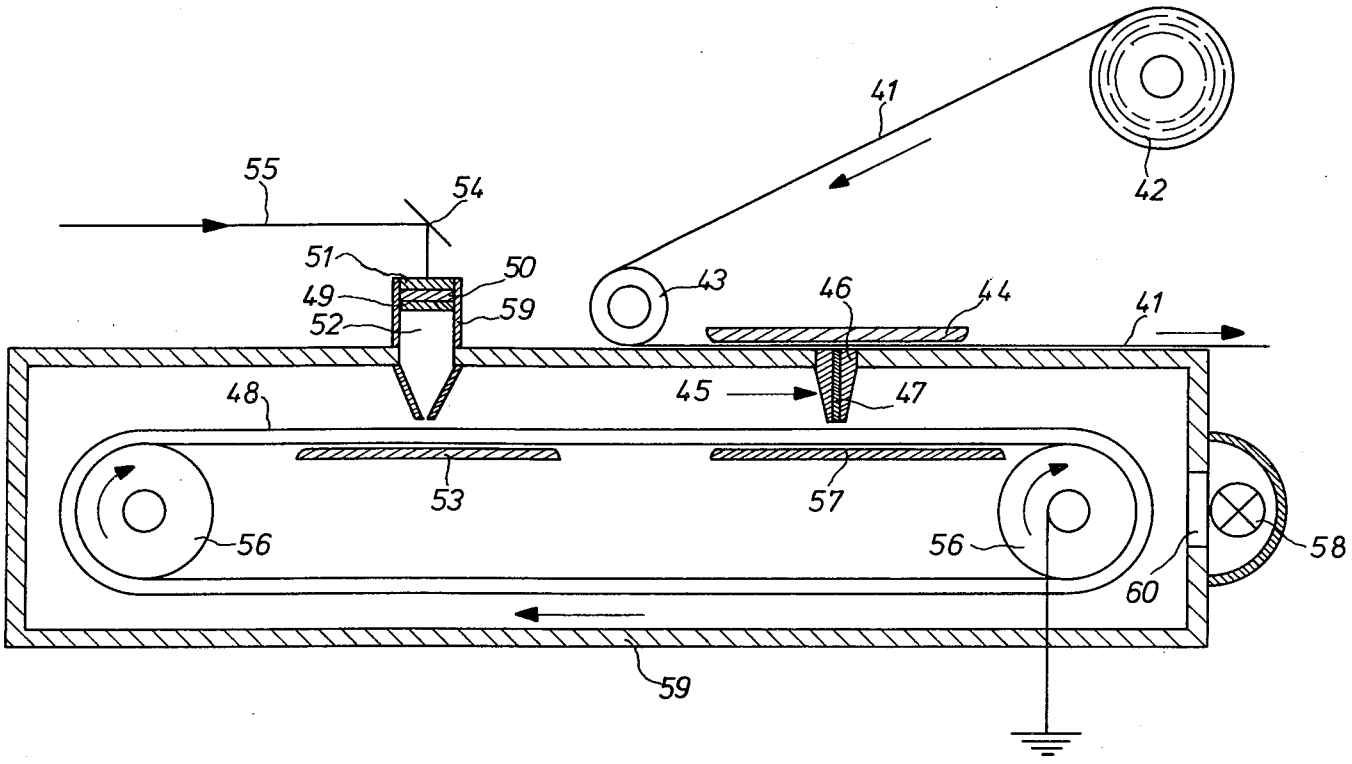
Figure 4:
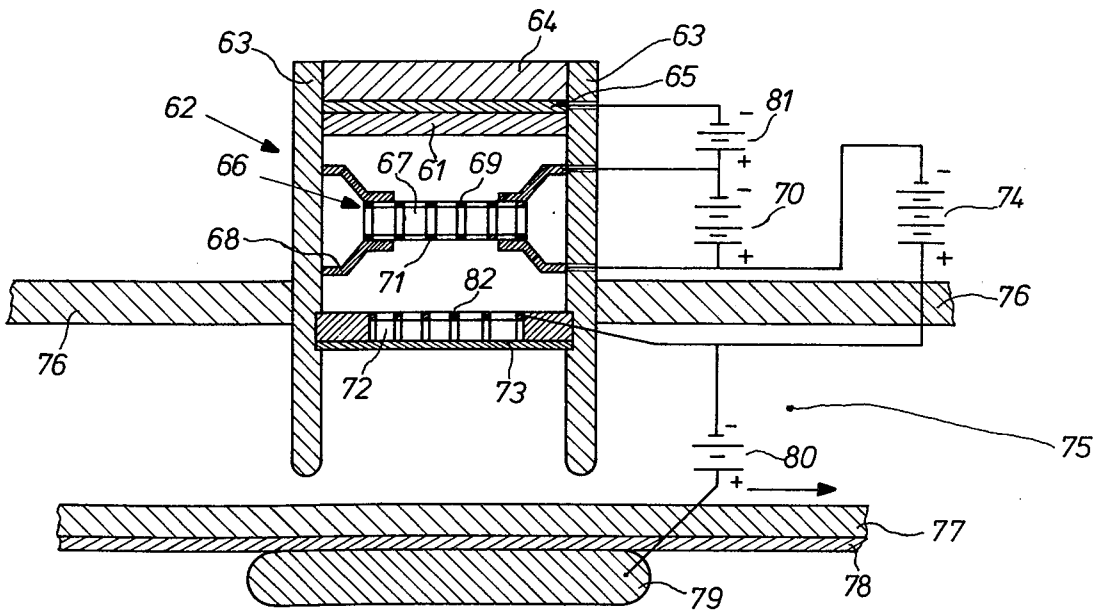

The basic elements of a particular recording apparatus of the present invention are illustrated by the accompanying schematic drawing wherein FIG. 1 is a cross-sectional representation of a recording system structure of the present invention in which an ionizable gas is used, FIGS. 2 and 4 are cross-sectional representations of photoelectron-emitting devices useful in the process of the present invention and FIG. 3 is a cross-sectional representation of an imaging structure useful in combination with a scanning exposure system.

It should be understood that in these figures certain dimentions of the layers, photocathode, optionally used micro-channel plate, insulating target, etc., have been greatly exaggerated to show the details of construction.

No inferences should, therefore, be drawn as to the relative dimensions of the layers or spacings separating the various elemental parts of the imaging apparatus.

The reproducing system illustrated in FIG. 1 employs a insulating charge receiving material 1 supplied as a web or film from a supply reel 2. The web is taken off the supply reel 2 and moved to the left, as shown by the arrow, around a guiding roller 3 and introduced between a conductive backing plate 4 and a pin-matrix 5 in which the conductors are fine wires 6 or fibres of conductive material which are substantially uniformly spaced from each other, are in parallel relation to each other and are aligned perpendicular to the major plane of the wall. They are hermetically sealed to each other by an insulating material 7, e.g. glass or insulating resin.

Inside the gas tight envelope 15 a photocathode 8 is deposited as a layer onto a conductive coating 9 which is e.g. a material providing good adherence for the photocathode material. For a photocathode (photoemitter) having a base of antimony, Ni-chrome is a suitable backing material. X-ray sensitive photocathodes are e.g. made of lead or uranium. Parallel with the photocathode 8 an internal insulating charge receiving web 10 is arranged in the form of an endless belt that can be moved with two magnetically or electrically driven supporting rollers 11.

The interal charge receiving web 10 is at rest during the exposure of the photocathode 8 and moves after the exposure in the direction of the pin matrix 5 in order to allow the transfer of the charge pattern of the web 10 onto the external charge receiving web 1. A guiding plate 12 keeps the web 10 perfectly flat in the exposure stage and a guiding plate 13 ensures a good contact ot the charge carrying surface of the web 10 with the input-ends of the conductive wires 6.

Between the conductive guiding plate 12 and the backing layer 9 of the photocathode a DC potential difference is maintained during the exposure of the photocathode 8. The positive pole of the DC potential source (not shown in the drawing) is connected to the guiding plate 12 and the negative pole to the backing layer 9.

During the charge transfer a DC potential is applied between the internally positioned guiding plate 13 and the externally positioned guiding plate 4 in order to improve the charge transfer.

In order to make possible the formation of successive electrostatic charge patterns on the charge receiving web 10, the rub 10 is also constituted that it can be made electrically conductive upon non-information-wise (overall) irradiation with electromagnetic radiation (photons), in other words the charge receiving member is photoconductive. It may also be so constituted that it can be made electrically conductive upon non-information-wise (overall) photon-excitation (effecting molecular and/or atomic vibration) e.g. through infra-red irradiation, in other words in that case the charge receiving member is thermoconductive.

In the apparatus illustrated in FIG. 1 an exposure source 14 emitting electro-magnetic radiation increasing the conductivity of the web 10 is arranged outside the envelope 15 which has a window 16 that is transparent for the emitted radiation. The residual charges are carried off to the ground through the roller 11 which is electrically conductive. The web 10 is e.g. an organic polymeric photoconductor web coated at the rear side with a conductive layer e.g. vacuum evaporated aluminium (not shown in the drawing) or is a flexible belt coated with an organic or inorganic photoconductor e.g. a flexible selenium belt as described in Phot.Sci. Eng., 5 (1961) 90.

The envelope 15 is filled with an ionizable gas or gas mixture in admixture with a discharge quenching substance e.g. ethanol as described e.g. in the German patent specification No. 1,497,093. The filling gas is advantageously kept under an over pressure of only a few Torr, e.g. 5 Torr. A useful gas mixture consists e.g. of argon and monobromotrifluoromethane ($CF_3Br$) in the weight ratio 1:5. When using the above fluoromethane a separate quenching additive is not required. The applied DC voltage is preferably not more than 5 % above the breakdown voltage of the gas.

The distance between the photocathode 8 and the web 10 is preferably in the range of 0.3 to 3 mm. Such distance and the potential difference between the photocathode and the rear side of the insulating web material 10 forms an accelerating field acting upon the electrons and determine together with the kind of ionizable gas and its pressure the degree of the electron avalanching effect.

According to a special embodiment the photocathode is provided with a screen having minute holes for preventing the divergence of the electrons and improving image sharpness.

According to an embodiment described in the German patent specification No. 1,497,093 the minute holes of the screen, the diameter of which may be e.g. 0.2 mm and the depth e.g. 0.8 mm can be made in a plastic material or metal screen. By means of a screen having above hole dimensions, the photo-electrons which, when liberated by X-rays, are emitted in all directions from the heavy metal layer are directed in such a way that the ones diverging by more than 15° from the perpendicular on the plane of the electrode become absorbed. On one side of the screen the hole sides are connected with the electrode, on the other side the holes are covered with a thin, e.g. 0.01 mm thick aluminium foil.

The aliminium foil covering the openings of the screen serves as an electrode and the electrons emitted therefrom interact with the ionizable gas particles and effect the avalanching process. The sideways spreaded electrons present in the electron-multiplying avalanche are not removed by the above defined screen and still impair the image sharpness. Thus, the above described embodiment, which is valuable for eliminating electrons that are obliquely emitted from the photocathode does not remedy for image unsharpness resulting from the sideways electron spreading in the electron multiplicating avalanche in the ionizable gas medium.

Therefor, according to another embodiment, described in more details in our copenging United Kingdom patent application No. 24,169/73 filed on May 21, 1973 and entitled "Electrostatic Imaging Device and Process Using Same" which is to be read in conjunction herewith a photocathode having a plurality of narrow passages is placed in the ionizable gas medium and is directed with its windowless output-openings toward the charge receiving target.

The electron image need not necessarily be produced with a photocathode as it may be produced in various ways. For example, use can be made of an information-wise modulated scanning electron beam which optionally is projected onto a source of secondary electron emission from which secondary electrons are projected as an electron image, onto the target. In other words use may be made of a cathode ray type appliance comprising a removable insulating target sheet or ribbon on which the electrostatic charge pattern can be produced. Particulars about cathode ray tubes used in electrostatic recording are described e.g. in the Journal of Applied Physics Vol. 30, Dec. (1959) pages 1870–1873 and in the U.S. Pat. No. 3,007,049.

According to an embodiment which has been illustrated in FIG. 1, the electron image is produced with a photocathode by information-wise exposing such cathode to a pattern of radiant energy representing the information to be recorded thereby causing the emission of photoelectrons in a pattern corresponding with the pattern of radiant energy.

In the envelope the ionizable gas may be present under reduced pressure e.g. 0.1 to 10 Torr or when applying the recording techniques described in the German patent specification No. 1,497,093 or in the published GErman patent application No. 2,231,954 may be present under an over-pressure of say 5 Torr above atmospheric pressure (760 Torr).

When using the device for X-ray recording, the solid state photocathode may be omitted when using in the envelope an ionizable gas having a high X-ray absorption power, preferably having an atomic number of at least 36, which is kept at a pressure above atmospheric pressure. For such a type of recording technique in which electrons and positive ions are produced reference is made to the Belgian patent specification No. 792,334 and to the method of producing a fluorescopic image described by A. Lansiart et al. in Nuclear Instruments and Methods 44 (1966), 45–54.

The present invention includes the above X-ray recording techniques to produce an electrostatic charge pattern on the internal insulating material.

The present invention includes not only embodiments in which the electron-multiplication results from gas ionisation and an optional electron avalanching effect but likewise includes those embodiments in which electron multiplication is the result of secondary emission or in a solid material.

According to a special embodiment the information-wise emitted electrons are guided in microchannels in which secondary emission takes place by the collision of such electrons with the inner walls of a microchannel plate. In that case however, the channel plate must have innerwalls that are sufficiently electrically resistive and have secondary emissive characteristics e.g. as described in the United Kingdom patent specification Nos. 954,248, 1,064,072, 1,064,073, 1,064,074 and 1,064,075 and Advances in Electronics and Electron Physics Vol. 28 (1969) pages 471–486, and in Philips Technical Review Vol. 30 (1969) pages 239–240. The gas pressure in the envelope is then preferably below $5 \times 10^{-4}$ Torr in order to avoid a self-sustaining discharge resulting from ionic feedback (see Advances in Elctronics and Electron Physics Vol. 28 (1969) page 503).

Very good electron multiplication can be obtained by combining secondary electron transmission multiplication material with a channel plate intensifier as described in the U.S. Pat. No. 3,660,668.

In FIG. 2 a photocathode structure with electron-multiplying channel plate is illustrated. Such structure is built into the imaging device of FIG. 1 and replaces therein the photocathode 8 and the conductive backing 9.

In FIG. 2 the photocathode is represented by the layer 20, the microchannel plate by the apparatus part 21. The insulating charge receiving web of FIG. 1 is here the element 22. This web is coated at its rear side with a conductive layer 23 e.g. a vacuum coated aluminium layer. The microchannel plate 21 is in close proximity to the photocathode 20 e.g. its input openings are at a distance less than 0.3 mm of the photocathode 20. The photocathode 20 is of the type described in the German patent specification No. 1,497,093 e.g. is a 1.5 micron layer of lead or a 1.0 micron layer of uranium applied on an aluminium sheet 24. During the information-wise X-ray exposure of the photocathode 20 a DC-potential difference is applied by means of the potential source 25 between the input and output ends of the microchannel plate 21. These ends are covered (e.g. by vapour-deposition), without blocking the openings of the individual microchannels, with the electroconductive layers 26 and 27. The DC-potential source 25 is connected with the minus pole to the conductive layer 26, which is facing the photocathode 20, and with the plus pole to the conductive layer 27, which is directed to the insulating web 22.

The microchannel plate 21 is supported and held in parallel position to the photocathode 20 by the rectangular annular clamp 28 which clamp ensures the electrical contact of the coatings 26 and 27 with the potential source 25. The clamp is electrically insulated from the envelope 29 by the material 31. Between the electroconductive layer 27 and the conductive coating 23 of the insulating charge receiving web 22 (the internal insulating material) a potential difference is applied for attracting the electrons leaving the microchannel output openings onto the web 22. The plus pole of the potential source 30 is connected to the conductive layer 23 of the insulating web 22. Variable resistors (not shown) make it possible to adapt the voltage of the potential sources 25 and 30 in view of the desired electron gain. Optionally, between the rear side of the photocathode 20 i.e. the conductive backing 24 and the input-openings of the microchannel plate 21 a potential difference is applied with a DC voltage source (not shown) in order to accelerate them towards the microchannel plate 21. Before the photoexposure, the envelope in which the web 22 is present is evacuated to a reduced pressure smaller than $10^{-3}$ Torr.

According to a modified embodiment of the imaging apparatus represented in FIG. 2 the microchannel plate is provided on its conductive input opening ends with an electrically insulating solid material which does not block the channel openings. The microchannel plate contacts the photocathode or is sealed to the photocathode through this electrically insulating solid material. The insulating solid material contacting the photocathode may be a second microchannel, which can be secondarily emissive or not as desired, but lacks conductive end coatings and has its openings arranged in registration with the openings of the channel plate that is connected with its ends to the potential source 25. According to a preferred embodiment the openings of the first insulating channel plate are much larger than those of the channel plate to which a potential difference between input and output openings is applied, e.g. the ratio of the diameter of their openings is e.g. 5:1. The risk of damaging the channel plate is strongly reduced by the use of a channel plate that is supported by the photocathode.

In the present imaging process the material of the photocathode may be any type of photo-electron emitting substance or composition known in the art. For example, it may be directly sensitive to $\gamma$-rays, X-rays, visible light and/or ultra-violet or infra-red radiation.

A non-limitative survey of photocathode material is given by H. Bruining in his book Physics and Applications of secondary Electron Emission - Pergamon Press Ltd. - London (1954).

Examples of photocathodes used in various vacuum operated electronic image tubes, such as image intensifier tubes, are e.g. photocathodes of the silver-oxygen-caesium type ($S_1$) for near infra-red conversion or of the antimony-sodium-potassium-caesium type ($S_{20}$) for visible light applications (see Philips Technical Review, Vol. 28, (1967) page 169).

These photocathodes are sensitive to atmospheric conditions and are therefor only applied in high vacuum (less than $10^{-3}$ Torr) or inert gas electronic devices that need not be demounted or opened. An example of the use of such photocathodes in an X-ray image amplifier tube has been given in The Physical Basis of Electronics of J. G. R. Van DyckCentrex Publishing Company - Eindhoven (1964) page 209. In such tubes the photocathode system consists of a photocathode which is sensitive to light emitted by a fluorescent layer that fluoresces when struck by X-rays and that receives photoelectrons emitted by a lead layer applied to an aluminium support carrying the fluorescent layer.

The microchannel device used in the present invention as explained in connection with FIG. 2 may be defined as a resistive matrix including narrow passages arranged in substantially parallel relationship to each other with their end openings constituting the input and output faces of the matrix, such input and output faces being each coated with an electrically conductive layer, the conductive layer on the input face of the matrix serving as an input electrode, and a separate conductive layer on the output face of the matrix serving as an output electrode, the distribution and cross-section of the narrow passages (microchannels) and the resistivity and the secondary-emissive properties of the matrix being such that the resolution and electron multiplication characteristic of any one channel unit area of the device is substantially similar to that of any other channel unit area in order to avoid image distortion.

In the operation of the channel electron multiplier device a suitable DC-potential difference e.g. 0.5 –5 kV is applied over the input and output opening electrode materials so as to set up an electric field to accelerate the electrons (photo-electrons and secondary emission electrons), thereby establishing a potential gradient over and a current flowing through the electron-emissive material present on the inside surface of the channels or, if such channel inner coating is absent, through the bulk material of the matrix.

Secondary-emissive multiplication takes place in the channels and the output electrons may be acted upon by a further accelerating field which may be set up between the rear of the insulating target sheet and the output openings of the microchannels.

Between the photocathode and the electrode on the input openings of the microchannel plate an electric field may be applied. When that field is so strong that the photoelectrons are travelling along straight lines, i.e. nearly parallel to the tube axis at the input, no multiplication or only poor multiplication takes place, for an insufficient number of collisions is produced. It is possible to correct for this by tilting the channels of the plate e.g. in the range of 1 to about 10° with respect to the perpendicular on the photo-electron-emitting surface.

Secondary-emissive electron multiplier devices of the type of the microchannel plate described in connection with FIG. 2 of the present invention are described e.g. in the United Kingdom patent specification Nos. 950,640, 1,064,072, 1,064,073, 1,064,074, 1,064,075 and 1,137,018 and in the Canadian patent specification Nos. 750,037, 779,996 and 866,923.

The length-to-diameter ratio of the narrow passages or microchannels of the microchannel plate is preferably in the range of 100:1 to 50:1. The diameter of the channels determining the image resolution of the system is preferably not larger than 200 microns. Mircochannels of 40 microns diameter are commercially available in the form of a disc specified as channel electron multiplier plates G 40–25 and G 40–5 by Industrial Electronic Division, Mullard Ltd., Mullard House, Torrington Place, London, W.C. 1 E 7 HD.

If the channels do not have resistive inner surfaces, the bulk material of the matrix preferably has a resistivity in the range $10^9$–$10^{11}$ ohm.cm; the actual value is determined by the maximum output current that will be drawn from the device.

The manufacturing techniques for channel plates are quite similar to those used for fibre optics (see United Kingdom patent specification No. 1,064,072, KAPANY, N.S., "Fibre Optics : principles and applications", Academic Press, New York 1967), and G. Eschard and R. Polaert, Philips Technisch Tijdschrift 30, (1969) pages 257–261.

Tubing of poorly conductive glass is drawn to the required diameter in one or more stages. Channels of already small diameter e.g. 500 microns are assembled and then the bundle is drawn down to the required size e.g. 40 microns. The individual channels or multiple units (bundles) when large plates are made e.g. of 30 cm × 40 cm may be adhered or fused together to make up the required area. Small bundles are sliced, large bundles are ground and/or polished to obtain the required area. The input and/or output area of the plate may be curved, but in order to avoid image distortion the curvature should be the same for both window faces.

In order to obtain secondary electron emission the inner surface of the thin glass tubes is covered with a substance having secondary electron emission properties (see Physics and Applications of Secondary Electron Emission by H. Bruining - Pergamon Press Ltd., London (1954) page 17).

In the Journal of Scientific Instruments (Journal of Physics E) 1969, Series 2, Volume 2, pages 825–828, channel electron multipliers have been described in which the inner surface of the glass tubes is coated with lead or vanadium oxide. The inner surface of the tubes is prepared before or after reaching the final diameter.

The individual electron multiplying channels are connected electrically in parallel by evaporating e.g. a thin NI-chrome film at an oblique angle onto the two open channel window faces of the plate, but leaving each multiplier channel open. A peripheral ring electrode may be pressed against each face of the plate to establish the electrical contact.

The open area of suitable plates is preferably not smaller than 60 % and at present reaches 80 %.

The channels may contain some amount of gas molecules. In operation residual gas molecules near the output of the plate are accelerated back down the channels and may start additional cascades by striking the channel wall near the input. The incidence of ionic feedback depends on the residual gas pressure and the electron density. As already explained at sufficiently high pressures and gains, an undesirable a self-sustaining discharge can occur. With pressures below $10^{-5}$ mm Hg channel electron multiplier plates can be operated with gains in excess of $10^5$ without trouble, while at $10^{-3}$ mm Hg plates have been operated successfully with gains of several thousands (see Mullard Technical Communications No. 107, Nov. 1970, p. 170–176).

An element appropriate for the multiconductor wall section of the envelope of the imaging device is available under the trademark "Multilead" from Corning Glass Works, Industrial Bulb Sales Department, Corning, N.Y. It is available with a number of different conductor materials and sizes and a number of different spacings between the conductors. The "Multilead" material comes in sheet or strip form and can be incorporated into the envelope wall 15 (see FIG. 1) by a suitable glass fusion technique.

A process for producing fibres containing a metal core is described in the United Kingdom Pat. No. 1,064,072. According to this technique, metal-cored glass fibres are drawn down till a sufficient length of 200–300 micron fibre is obtained. A bundle of fibres is made by sealing the fibres together and is then cut into lengths of say, 10 cm. Each of these lengths of bundle is then drawn down in the same way as the original tube, equipped with an external cladding of thin insulating glass and drawn down till it is about 50 micron in diameter. This glass fiber containing a metal wire e.g. copper is quite easy to handle. According to that technique 10 $\mu$ fibres that are assembled in bundles or plates can be made. See for such a technique also Philips Technisch Tijdschrift (1969) No. 8/9/10, page 259.

The wires or pins in the matrix should be preferably short and the dielectric constant of the binder material low so as to obtain high charge transfer speed and maximum image resolution.

The transfer of the electrostatic images may proceed by conduction of electrical charges across a gas or air gap or by direct charge transfer when a gas or air gap is not present or eliminated.

Image sharpness is practically unaffected by charge transfer or contact. This requires, however, a close and direct contact of the ends of the conductive wires with the insulating charge carrying material. Such intimate contact is obtained in practice by operating with very smooth surfaces that are placed together under pressure.

In order to avoid image distortion as much as possible the member on which the charge image inside the imaging envelope is produced is in the form of rigid plates that are arranged on an endless carrier belt or are connected to each other in the form of an endless belt with hinges or flexible joints. In the exposure stage each plate is positioned in contact with an electrically insulating ring surrounding the photocathode. The height of the ring is such that the distance between the photocathode or other electron emitter and the charge receiving plate ensures optimal electron multiplication At the charge transfer stage each plate is pressed against the input side of the matrix block containing the charge transferring wires.

With the apparatus of the present invention all kind of reproduction and copying work can be done e.g. document copying, micro-film enlargement, fac-simile, X-ray photography and even cinematography e.g. by operating at 6 to 16 image frames per second. In connection with document copying and facsimile attention is directed to the embodiment represented in FIG. 3 in which the production of the charge pattern proceeds scanning-wise with a photocathode strip and the transfer of the carge pattern optionally proceeds with a wire-matrix block containing a single row of wires positioned between the insulating charge receiving material inside the imaging envelope and the removable charge receiving material outside said envelope.

The reproducing system illustrated in FIG. 3 is partly the same as the one described in FIG. 1. It employs a web-like insulating charge receiving material 41 supplied from a supply reel 42. The web 41 is taken off the supply reel 42 and moved to the left, as shown by the arrow, around a guiding roller 43, and introduced between a conductive backing plate 44 and an insulating wire matrix 45 containing a single row of substantially parallel conductive pins 46 embedded in an insulating material 47. The length of the row of pins is somewhat smaller than the width of the receiving web 41. The pins 46 penetrate the envelope face and permit the charge of the insulating web 48 to be transferred to the web 41. The charge pattern is produced line-wise by progressive line-wise exposure with e.g. visible light of the photocathode 49 which is in the form of a layer strip having the width of the charge receiving insulating web 48. The photocathode material, e.g. made of photoemissive cesium-antimony is, applied on a transparent conductive electrode strip 50, e.g. vacuum deposited aluminium, on the transparent wall 51, e.g. made of glass transparent to visible light. NESA glass (which is tin oxide coated glass) is perfectly suited for producing the elements 50 and 51. The walls or envelope material of the vacuum or low pressure chamber are electrically insulating. By employing a very close spacing between the photoelectron emitting surface and the charge receiving web 48, the use of magnetic or electrostatic focussing coils and the like is made unnecessary. However, relatively simple magnetic or electrostatic focussing systems may be employed.

In order to obtain electron multiplication the photocathode chamber 52 may contain the already described ionizable gas or gas mixture or a single row or plurality of rows of secondary emissive microchannels (not shown in the drawing) having the input and output electrodes thereof kept e.g. at 1 kV by a DC voltage source, the negative pole being connected to the input ends and the positive pole to the output ends. Between the conductive backing 50 and the guiding plate 53 a potential difference is applied for driving the emitted electrons towards the insulating web 48. The photocathode strip 49 is progressively linewise exposed according to a technique known in office copying apparatus e.g. as described in the article of K. H. Arndt "Wie funktioniert ein elektrophotographischer Kopierautomat" - Photo-Techniek und Wirtschaft Nr. 6 -1971) page 191 dealing with the GEVAFAX X-10 office copier (GEVAFAX is a trade name of Agfa-Gevaert N.V., Belgium). In FIG. 3 the element 54 represents a mirror having the width of the photocathode strip 49. The light beam 55 originates from a scanning system (not shown in the drawing) applied in the GEVAFAX X-10 apparatus.

The charge receiving web 48 is arranged in the form of an endless belt and is moved by two supporting rollers 56 that from outside the envelope are magnetically driven. The charge-receiving web 48 mores synchronously with the progressive linewise exposure and so likewise does the external charge receiving web 41. A guiding plate 57 ensures a good contact of the charge carrying surface of the web 48 with the input ends of the conductive wires 46.

In the apparatus illustrated in FIG. 3 the charge receiving web 48 has a photoconductive layer, e.g. is a selenium layer or photoconductor layer based on poly-N-vinyl carbazole, applied to a flexible endless belt metal support. An exposure source 58 emitting electromagnetic radiation e.g. ultra-violet light which increases the conductivity of the photoconductor layer of the web 48 is arranged outside the vacuum or reduced pressure chamber envelope walls 59. The envelope has a window 60 that is transparent for the emitted radiation. The residual charges are carried off to the ground through the roller 56 which is electrically conductive.

Depending on the type of electron multiplication the room inside the envelope walls is evacuated up to say $10^{-4}$ to $10^{-5}$ Torr in order to allow the use of the secondary emissive microchannels or is filled with an ionizable gas for obtaining gas ionization and optionally the described electron avalanching effect.

According to a special embodiment both systems of electron multiplication, the one with secondary emission in a solid matrix and the one based on gas ionization and electron avalanching are combined. In FIG. 4 a cross-sectional view of such a device suitable for use in the present invention is illustrated. The device is represented in FIG. 4 in the form of an "exposure-head" that is suited for linewise progressive exposure of the photocathode as explained in connection with FIG. 3.

FIG. 4 represents an "exposure head" in which the photocathode 61 is arranged in a housing 62 consisting of two parallel insulating plates e.g. glass plates 63 that are provided at the front and rear side (parallel with the plane of the drawing) with two closing plates. At the top of the housing a glass strip 64 (transparent for visible light) coated with a transparent conductive layer 65 e.g. a NESA-glass coating (NESA is a trademark of Pittsburgh Plate Glass Co. — U.S.A.) is applied in gas tight fashion. A microchannel plate 66 containing a single row or a row of a plurality of secondary emissive microchannels 67 is applied at 2 to 5 mm from the photocathode 61. The microchannel plate 66 is carried by and fixed to the housing by an insulating clamp 68 containing leads connecting the input electrode ends 69 to the minus pole of a DC potential source 70 and the positive pole to the output electrode ends 71 of the microchannel plate 66. A DC-voltage source 81 is connected to the layer 65 and the electrode 69.

A second insulating microchannel plate 72 which does not necessarily have secondary emissive walls is arranged below the microchannel plate 68. The input opening ends of plate 72 are provided with an electrode layer 82 that does not block the input-openings. The output openings of plate 72 are blocked or covered with a window 73 of electron beam penetrative nature. For example the window 73 is a thin film of a metal (aluminium, nickel, etc.) or of metal oxide ($Al_2O_3$) or a semiconductor whose thickness lies within a range of a fraction of 1 micron to several microns (for a detailed description of electron-beam penetrative windows see U.S. Pat. No. 3,611,418). An electron beam whose energy is in the order of several ten keV(kiloelectron-volt) e.g. 40 keV can easily pass through a film window with the specified thickness.

The electrons pass through the thin film window 73 by the voltage applied with the DC-source 74. After penetrating the window 73 they impinge against gas particles present in the envelope 75 which is closed with the wall 76 (partly shown). The ionized gas particles emit one or more electrons and a cumulative electron emission takes place resulting in the so-called electron avalanching effect. The voltage across the distance between the electrode 82 and the charge receiving insulating endless belt part 77 (partly shown in the drawing) depends on the pressure residing in the envelope 75. For the relation between the gas pressure P, the strength of the electric field E and the first Townsend's coefficient, reference is made to FIG. 4 of the U.S. Pat. No. 3,611,418, to the breakdown voltage versus pressure curves of M. Knoll, F. Ollendorff, and R. Rampe, Gasentladungstabellen Springer Verlag, (1935) p. 84, and to the breakdown voltage at minimum of Paschen curve for various gases described by A. von Engel, Ionized Gases, Clarendon Press, Oxford (1955) p. 172.

The insulating layer 77 is carried by a conductive web e.g. flexible steel belt 78 or aluminium belt that is kept substantially flat by the guiding plate 79. This plate is electrically connected to the conductive input electrode 82 of the microchannel plate 72 through a DC voltage source 80.

The exposure of such an "exposure-head" proceeds e.g. with a flying spot scanner attached with its screen window to the covering plate 64. For the use of a "flying spot scanner-cathode ray tube" in rapid access continuous tone recording (CRT) reference is made to Phot.Sci.Eng. 5, 137 (1961).

In the housing 62 containing the secondary emissive microchannel plate, a vacuum of $10^{-4}$ to $10^{-5}$ is created before assembling the exposure head with the walls 76.

The photocathode is formed and assembled with the walls 63 e.g. according to the so-called "Transfer Technique" described in Philips Technisch Tijdschrift, (1969) no. 8/9/10, p. 238–240. The assembly of the window on which the photocathode is deposited by vacuum evaporation is affixed to the plates 63 by cold welding under pressure (see FIG. 1 of said article) while for assembling the microchannel plate with the Lenard window 72 at the bottom side of the plates 63 the same procedure of cold welding under high vacuum conditions may be applied.

The invention is not limited by the type of development of the electrostatic charge pattern on the removable insulating material.

The development of the electrostatic charge image proceeds preferably with finely divided electrostatically attractable material that is sufficiently non-transparent to visible light, but may proceed by surface deformation by a technique known as "Thermoplastic Recording", see e.g. Journal of the SMPTE, Vol. 74, p. 666–668.

According to a common technique the development proceeds by dusting the insulating film or film layer bearing the electrostatic image with finely divided solid particles that are image-wise electrostatically attracted or repulsed so that a powder image in conformity with the charge density is obtained.

The expression "powder" denotes here any solid material e.g. finely divided solid material in liquid or gaseous medium, and that can form a visible image in conformity with an electrostatic charge image. Well-established methods of dry development of the electrostatic latent image include cascade, power-cloud (aerosol), magnetic brush, and fur-brush development. These are all based on the presentation of dry toner to the surface bearing the electrostatic image where coulomb-forces attract or repulse the toner so that, depending upon electric field configuration, it settles down in the electrostatically charged or uncharged areas. The toner itself preferably has a charge applied by triboelectricity. The powder image is e.g. fixed by heat or solvent treatment.

The present invention, however, is not restricted to the use of dry toner. Indeed, it is likewise possible to apply a liquid development process (electrophoretic development) according to which dispersed particles are deposited by electrophoresis from a liquid medium.

The dispersed toner particles may be any powder forming a suspension in an insulating liquid. The particles acquire a negative or positive charge when in contact with the liquid due to the zeta potential built up with respect to the liquid phase. The outstanding advantages of these liquid developers are almost unipolarity of the dispersed particles and their appropriateness to very high resolution work when colloidal suspensions are applied.

Suitable electrophoretic developers are described e.g. in the U.S. patent specification No. 2,907,674 and the United Kingdom patent specification No. 1,151,141.

The electrostatic image can likewise be developed according to the principles of "wetting development" e.g. as described in the United Kingdom patent specifications Nos. 987,766, 1,020,505 and 1,020,503.

According to a particular embodiment the charge pattern is developed in direct relation to the quantity of charge, instead of to the gradient of charge (fringe effect development). Therefor the developer material is applied while a closely spaced conductor is situated parallel to the insulating charge receiving member. In that embodiment the conductor is e.g. through a potential source, electrically connected to the conductive backing layer of the insulating member (see for such type of development e.g. PS&E, Vol. 5, 1961, page 139).

The transferred charge pattern may be formed on any type of electrographic recording material. For example a recording web consisting of an insulating coating of plastic on a paper base having sufficient conductivity to allow electric charge to flow from the backing electrode to the paper-plastic interface. For a particular electrographic paper, reference is made to the U.S. Pat. No. 3,620,831.

As substances suited for enhancing the conductivity of the rear side of a transparent resin web or sheet are particularly mentioned antistatic agents preferably antistatic agents of the polyionic type, e.g. CALGON CONDUCTIVE POLYMER 261 (trade mark of Calgon Corporation, Inc. Pittsburgh, Pa., U.S.A.) for a solution containing 39.1 % by weight of active conductive solids, which contain a conductive polymer having recurring units of the following type:

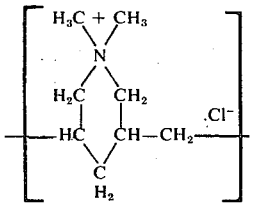

and vapour deposited films of chromium or nickel-chromium about 3.5 micrometer thick and that are about 65 to 70 % transparent in the visible range.

Cuprous iodide conducting films can be made by vacuum depositing copper on a relatively thick resin base and then treated with iodine vapour under controlled conditions (see J. Electrochem.Soc., 110–119, Feb. 1963). Such films are over 90 % transparent and have surface resistivities as low as 1500 ohms per square. The conducting film is preferably overcoated with a relatively thin insulating layer as described e.g. in the Journal of the SMPTE, Vol. 74, p. 667.

I claim:

1. A method of recording information as a pattern of electrostatic charges carried by an insulating charge receiving medium which comprises:

a. exposing to a pattern of X-ray, $\gamma$-rays, or the like an imaging chamber enclosing a pair of spaced imaging electrodes and containing an ionizable gas having an atomic number of at least 36, which chamber is adapted to produce upon such exposure electrostatic charges therein in a corresponding pattern, while maintaining said gas during said exposure under superatmospheric pressure;

b. arranging interior dielectric charge receiving material within said chamber in a charge receiving position in the space between said electrodes;

c. applying a DC potential across said electrodes to bias said charge pattern onto a surface of said dielectric material;

d. displacing the charge-carrying dielectric material from said charge-receiving position to a charge-transferring position within said chamber, in which transferring position said charge-carrying dielectric surface is disposed in close proximity to the interior ends of an array of discrete closely spaced conductors extending from the interior to the exterior of said chamber; and e. arranging an exterior dielectric charge-receiving material outside said chamber in close proximity to the exterior ends of said conductor array, whereby said charge pattern is transferred to said exterior dielectric material by way of said conductor array.

2. A method according to claim 1, wherein said gas is xenon.

3. A method according to claim 1, wherein the charge pattern formed on said removable receiving material is developed with an electrostatically attractable material.

4. A method according to claim 1 wherein one of said imaging electrodes is a photocathode and said charged particle pattern is generated by imagewise exposing said photocathode to a pattern of radiant energy representing the information to be recorded.

5. A method according to claim 4, wherein the photocathode is covered with a fluorescent coating that when struck by said rays emit electromagnetic rays having wavelengths for which the photocathode is sensitive.

6. A method according to claim 1 wherein said charge transfer is facilitated by applying a DC potential across a pair of transfer electrodes arranged one within and the other outside the chamber in close proximity to the oppositely facing surfaces of the respective dielectric materials.

7. A method according to claim 6 wherein the polarity of the interior electrode is the same as that of the charges on the dielectric material proximate thereto.

8. A method according to claim 1 wherein said interior dielectric charge-receiving material is moved cyclically between said positions for sequential exposure and including the step of removing residual charges from said material before the same is returned to said charge-receiving position.

9. A method according to claim 8 wherein said dielectric material is photoconductive and said residual charges are removed therefrom by passing said material through a light exposure position to uniformly expose the same to light intermediate said charge-transferring and charge-receiving positions.

10. A radiographic system for operation with a source of X-rays which comprises:

a. an imaging chamber enclosing a spaced pair of imaging electrodes;

b. means in said chamber for emitting a pattern of electrostatic charges when exposed to an X-ray image and including an ionizing gas medium;

c. a dielectric material disposed in said chamber in a charge-receiving position adjacent one of said electrodes;

d. means for applying an electrical potential across said electrodes for biasing said pattern of electrostatic charges towards said dielectric material in said charge-receiving position on a surface of said material;

e. an array of discrete closely spaced conductors disposed in the wall of said chambers at a locus spaced from said imaging electrodes, said array having one end of the conductors thereof in said chamber and the other end outside said chamber and extending through the chamber wall;

f. means for displacing said charge-receiving material from said charge-receiving position to a charge-transferring position with the charge-carrying surface thereof in close proximity to the interior ends of said conductors; and g. means for maintaining an exterior dielectric charge-receiving material in close proximity to the exterior ends of said array, whereby said charge pattern is transferred from the interior to the exterior dielectric material through said array.

11. An imaging system according to claim 10 wherein said imaging electrodes include a photocathode.

12. An imaging system according to claim 10, wherein said gas is xenon gas.

13. An imaging system according to claim 10 including a pair of transfer electrodes, one within and the other without said imaging chamber in close proximity to the surfaces of the respective dielectric material facing away from said array.

14. An imaging system according to claim 10 including means for feeding a web of dielectric material past the exterior ends of said array.

15. An imaging system according to claim 10 wherein said interior dielectric material is an endless web and including means for moving said web cyclically between said positions.

16. An imaging system according to claim 15 wherein said interior dielectric web is photoconductive and including means for exposing said web uniformly to light while moving from said charge-transferring to said charge-receiving position to remove residual charges therefrom prior to recharging.

17. An imaging system according to claim 10 wherein said chamber contains under high vacuum conditions (1) an imaging photocathode, (2) a secondary emission multiplier including a plurality of electron-multiplying narrow passages arranged in substantially parallel relationship to each other and in which electrons emitted by the photocathode can be accelerated in an electric field.

18. An imaging system according to claim 17, wherein the passages have a diameter not larger than 200 microns.

19. An imaging system according to claim 17, wherein the length-to-diameter ratio of the passages is in the range of 100:1 to 50:1.

20. An imaging system according to claim 17, wherein the secondary emission multiplier is a resistive matrix including narrow passages arranged in substantially parallel relationship and whose end openings constitute the input and output faces of the matrix, the two surfaces of said matrix where the passages open out being coated with an electrically conductive layer, the conductive layer on the input face of the matrix serving as an input electrode, a separate conductive layer on the output face of the matrix serving as an output electrode, the distribution and cross-sections of the narrow passages and the resistivity and the secondary-emissive properties of the matrix being such that the resolution and electron multiplication characteristic of any one channel unit area of the device is substantially similar to that of any other channel unit area.

21. An imaging system according to claim 20, wherein the secondary emission multiplier is made of glass tubes that are assembled together in substantial parallel relationship and in which the inner surface of the tube is covered with a substance having secondary electron emissive properties.

* * * * *